US007278482B2

(12) United States Patent
Azar

(10) Patent No.: US 7,278,482 B2
(45) Date of Patent: Oct. 9, 2007

(54) ANCHOR AND METHOD OF USING SAME

(76) Inventor: Ghassan R. Azar, 16422 Graven Hill Dr., Spring, TX (US) 77379-7160

( * ) Notice: Subject to any disclaimer, the term of this patent is extended or adjusted under 35 U.S.C. 154(b) by 121 days.

(21) Appl. No.: 10/995,906

(22) Filed: Nov. 22, 2004

(65) Prior Publication Data

US 2006/0108125 A1 May 25, 2006

(51) Int. Cl.
*E21B 29/02* (2006.01)

(52) U.S. Cl. ..... 166/262; 166/297; 166/299; 166/63

(58) Field of Classification Search ..... 166/55, 166/63, 118, 206, 256, 262, 297, 299; 102/314, 102/318, 322
See application file for complete search history.

(56) References Cited

U.S. PATENT DOCUMENTS 3,026,939 A * 3/1962 Sweetman ..... 166/63
4,125,161 A 11/1978 Chammas
4,158,389 A 6/1979 Chammas et al.
4,180,131 A 12/1979 Chammas
4,234,768 A 11/1980 Boop
4,250,960 A 2/1981 Chammas
4,428,430 A 1/1984 Terrell, I et al.
4,494,601 A 1/1985 Pratt et al.
4,620,591 A 11/1986 Terrell et al.
4,799,829 A * 1/1989 Kenny ..... 166/55
4,819,728 A 4/1989 Lafitte
4,949,789 A 8/1990 Lafitte
5,287,920 A 2/1994 Terrell
5,322,118 A 6/1994 Terrell
5,509,480 A 4/1996 Terrell et al.
5,531,164 A 7/1996 Mosley
5,575,331 A 11/1996 Terrell
6,702,009 B1 3/2004 Drury et al.

* cited by examiner

*Primary Examiner*—Lanna Mai
*Assistant Examiner*—Matthew J. Smith
(74) *Attorney, Agent, or Firm*—The Matthews Firm

(57) ABSTRACT

An anchoring tool to position an attached tool, such as a chemical cutter or other tools, in a predetermined position within the bore of a tubular. After the desired location for cutting the tubular or performing other functions is determined, the anchoring tool, along with the chemical cutter or other tools, is lowered into the bore of the tubular until the predetermined position is reached. Thereafter, an ignitor expands pressure propellants, positioned within the body of the anchoring tool, and produces pressure which causes anchoring slips to anchor the tool and any associated equipment within the interior of the tubular.

32 Claims, 4 Drawing Sheets

ANCHOR AND METHOD OF USING SAME

TECHNICAL FIELD

This invention relates to anchoring apparatuses and more particularly, to a new and improved anchoring system for an oil tool consisting of a single sub.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers.

DETAILED DESCRIPTION OF EMBODIMENTS OF THE INVENTION

It is well known in the art to use oil tools in a wellbore that must be anchored by an anchor tool. For example various chemical cutters that may be used to cut, sever, perforate, or slot an object within a wellbore. Such an object may include drill pipe, tubing, casing, tubulars, or foreign objects that are lodged in the wellbore. Typically, the chemical cutting fluid is contained in a cylindrical containment vessel which is lowered into a tubular or a wellbore to a desired discharge area. The fluid is then released, from the containment vessei, by utilizing a pressuring agent, such as black gun powder or the like, which causes a high pressurizing discharge. During this discharge process, the chemical cutter is preferably held in place by an anchoring system. Typically, the anchoring system consists of more than one sub which is connected uphole from the chemical containing vessel.

The apparatus, described herein below, preferably comprises an anchoring system housed in a single sub-unit which may be attached above the chemical cutter. However, it should be appreciated that the anchoring device, described herein below, can also be attached below a different type of pipe cutter which does not necessarily rely on chemicals for the process of cutting, gouging, perforating, etc. It should be further appreciated that the apparatus, described herein, can be utilized to position other tools in the interior of a tubular or wellbore to allow the tools to remain substantially anchored with respect to the longitudinal axis of the tool or the tubular into which the anchor and tool are lowered.

Figure 1:
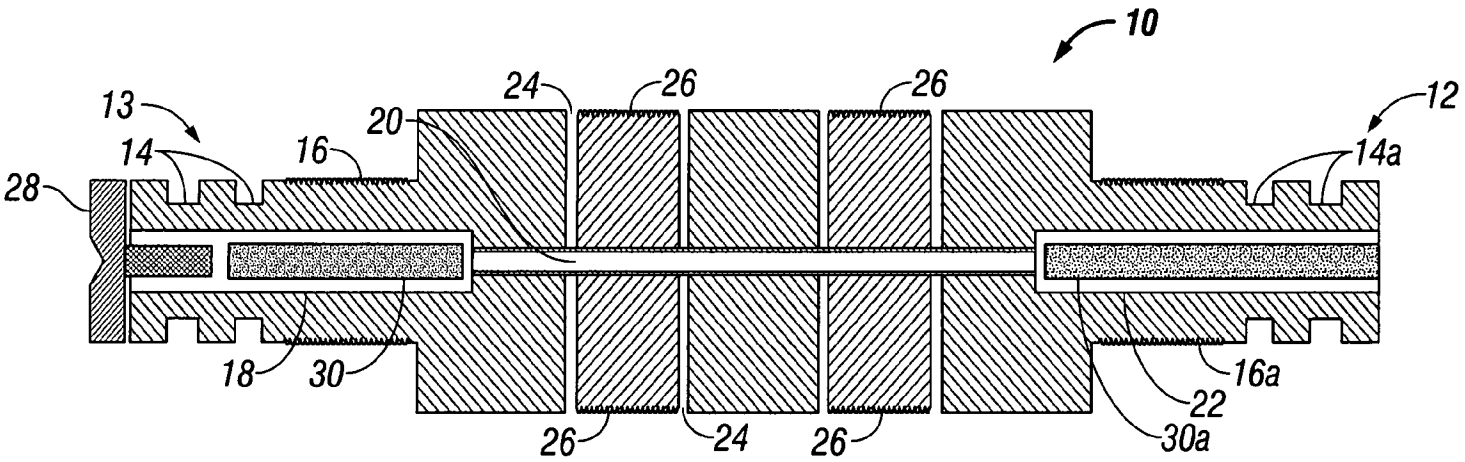
FIG. 1 illustrates an elevated side view partially in cross-section of an embodiment of the anchor according to the present invention.

FIG. 1 illustrates an embodiment of the single sub anchoring system. The anchoring sub comprises a body 10, which is preferably substantially cylindrical in shape. Preferably, the main body 10 has an upper end 13, and a lower end 12. The upper end 13 preferably comprises one or more o-ring grooves 14, and a threaded section 16. The threaded section 16 is configured so as to be attached to a wire line, other tubing, or other apparatus used in lowering the tool into the bore of a tubular to a predetermined. The one or more o-ring grooves 14 are used to seal any connection of the upper end 13. It should be appreciated that the connection configuration of the upper end 13 can be adapted to attach to any device used to lower a tool and anchor. Therefore, these connections are viewed as being within the scope of this invention and should not be viewed in a limiting sense. The bottom end 12, of body 10, is also configured to be adapted to one or more subs below the anchoring sub. Typically, a chemical cutter (not illustrated) is attached directly below the anchoring sub 10. Bottom end 12 also preferably has one or more o-ring grooves 14*a*, and a threaded section 16*a*. It should be appreciated that end 12 and end 13 may be configured in a similar fashion, or may vary in location and/or type of the thread 16, 16*a*, or o-ring grooves 14, 14*a*, depending on the type of attachment configuration required by tools, tubing, or any other attachments below or above the anchor sub 10. It should be further appreciated that the upper end 13 and the lower end 12 could be separate bodies. In such an embodiment, each separate body 12, 13 could be attached to the main body 10 by threaded connections, welding, couplings, pins, screws, or other methods of attachment. Further, such attachments could include various seals, both metallic and non-metallic, to impede or prevent fluid communication between the attachment points and areas external to the tool.

Still referring to FIG. 1, the upper end 13 further comprises an upper end chamber 18, which is in fluid communication with a second chamber 20 which is further in fluid communication with lower end, chamber 22. The second, or intermediate chamber 20, preferably has a reduced diameter from upper chamber 18 and lower chamber 22. The medial chamber or second chamber 20, further communicates with a plurality of apertures 24. Apertures 24 are preferably substantially cylindrical openings that allow fluid communication between the second chamber 20, and the outside of the sub-body 10. However, it should be understood that the aperture 24 shape can vary such that the cross-sectional shape, of the aperture, can include, but is not limited to, circular, elliptical, or a variety of polygonal shapes. It should be further understood that the shape will preferably substantially depend upon and match the shape of the anchor slips or blocks 26 and as such should not be viewed in a limiting sense. Each aperture, or opening 24, preferably houses an anchor slip or block 26. It should be appreciated that the anchor slip 26 may be referred to by a variety of names including, but not limited to, anchor slips, anchor blocks, dogs, stops, anchor pins, anchor grips, gripping blocks, slips, blocks, and the like. The particular name associated with the anchor slip 26 as well as the specific shape of the block should not be viewed as a limitation herein. Preferably, anchor sub body 10 will comprise at least six apertures, or openings 24, which will house six corresponding anchor slips, or blocks 26. Preferably, every two apertures 24 will be aligned substantially 180 degrees apart. Thus, preferably three sets of 180 degree apart positioned apertures 24 and anchor slips 26, will be positioned in the body 10, substantially symmetrically located between the upper end 13 and the lower end 12. It should be appreciated that although the preferred arrangement is to have three diametrically opposed sets of openings 24 and anchor slips 26 symmetrically positioned between upper end 13, and lower end 12, it is possible to have a large variety of positions of the anchor 26, including more than three sets of diametrically opposed positions or less than three sets, as well as offset positioned apertures 24 (i.e. the apertures 24 are not aligned with one another in 180 degree diametrically opposed positions).

Further illustrated in FIG. 1 is an ignitor 28 which is preferably a black powder ignitor which is well known in the art, and therefore, will not be described in further detail herein. Preferably, the ignitor 28 is attached to a wire line or other apparatus which can transmit an electrical signal to the ignitor 28. Preferably, when the anchor tool has been lowered to some predetermined depth, within a tubular, an electric signal is transmitted to the ignitor 28. The electrical current preferably causes the black powder, or other incendiary device being used in the ignitor 28, to combust and cause the ignition of pressure propellants 30, 30*a* described more fully herein below. However, it should be appreciated that other types of ignitors could be utilized dependent upon various conditions such as, but not limited to, particular applications, safety issues, environmental issues, availability of ignition systems, and the like. Preferably, ignitor 28 slidingly mounts into the upper end 13, into the upper side of chamber 18. Chamber 18 will also house a gas generator propellant 30, which is slidingly received into chamber 18, between middle chamber 20 and ignitor 28. A second gas generator propellant 30*a* will preferably be slidingly received in chamber 22, between the middle chamber 20 and the lower end 12. It should be appreciated that the position of the ignitor 28 could vary as well as the utilization of more than one ignitor 28.

Figure 2:
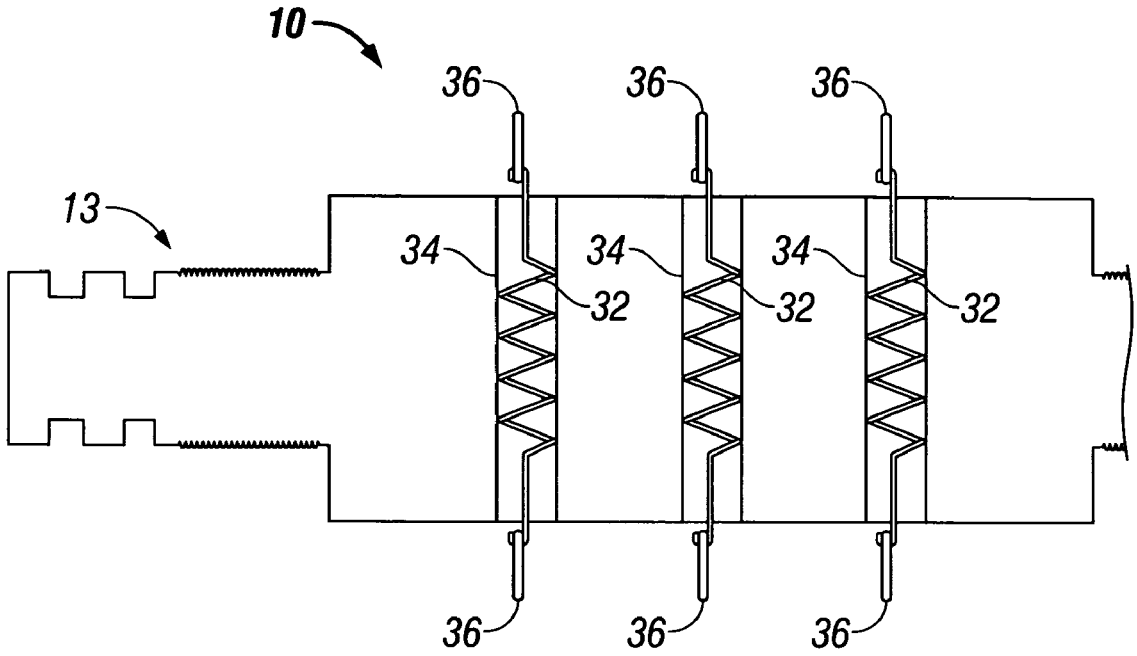
FIG. 2 illustrates an elevated partial side view partially in cross-section of the retention spring system for the anchor according to the present invention.
Figure 3:
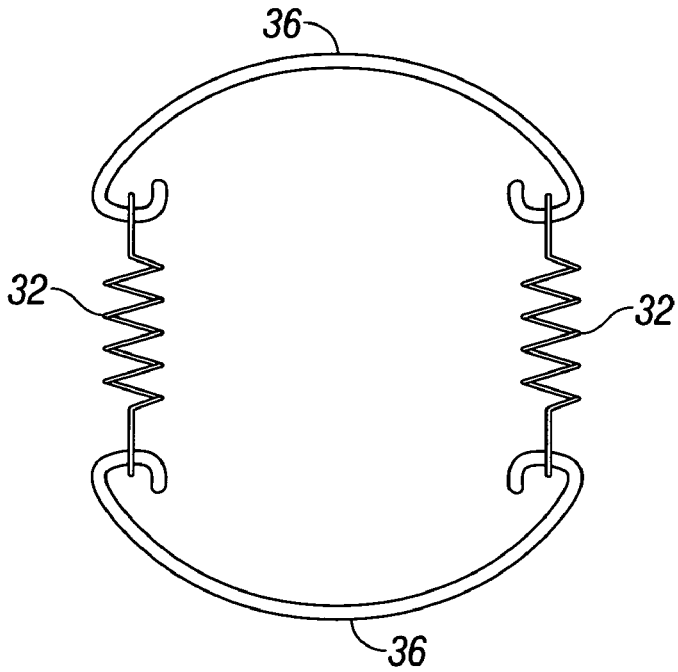
FIG. 3 illustrates a top plan view of an embodiment of a retainer for the spring used to retain anchor slips in the anchor of the present invention.

FIG. 2 illustrates an alternative embodiment of anchor sub 10 comprising retaining springs 32. The retaining springs 32 preferably maintain the anchor slips or blocks 26, in their retracted position. Each set of anchor slips or blocks 26, will preferably have two springs 32 which will maintain their retracted position. In embodiments, wherein the slips 26 are not diametrically opposed, it should be understood that a single spring 32 or a set of springs 32 would be required for each separate slip 26. Springs 32 are configured to fit into channels 34. Channels 34, in turn, are preferably machined on the outside diameter of the body sub 10, and are substantially parallel in the transverse direction of apertures 24. Preferably, channels 34 will be milled or machined on each side of aperture 24 on the outside surface of sub body 10. However, other methods of forming the channels 34 are considered within the scope of the invention. Therefore, for each aperture 24 and anchor slip 26, there will be one set of channels 34, and one set of springs 32. It should be appreciated that when apertures 24 and anchor slips 26 are arranged as a set (i.e. diametrically opposed), each set of springs 32 will retain two anchor slips or blocks 26. Each spring 32 of a set will preferably be connected together by a set of retaining clips 36 (FIG. 3). Each retaining clip 36 will preferably attach to one end of the first spring 32, and will substantially follow the curvature of anchor sub-body 10 over the anchor slip or block 26, and attach to the end of the corresponding spring 32 diametrically opposed to the first spring 32. A second retaining clip 36 will attach to the opposite end of each spring 32 and will also follow the curvature of anchor sub 10. It should be appreciated that retaining clip 36 will pass over, and will be in contact with anchor slips 26, thereby holding the anchor slips 26 in the retained position when the spring 32 is contracted. It should be understood that other methods of retaining anchor slips 26 in the aperture 24 may be utilized. It is envisioned that the springs 32 may be located interior to the anchor slips 26, thus holding the anchor slips 26 from the interior. In such an embodiment, the springs would attach between the anchor slip 26 set. However, it should be noted that this is not a preferred embodiment in that the internal springs may interfere with the flow and/or pressure (to be described later) in intermediate chamber 20. Nonetheless, the internal springs 32, as well as other forms of retention of the anchor slips 26, in a retracted mode, may be utilized.

Figure 4:
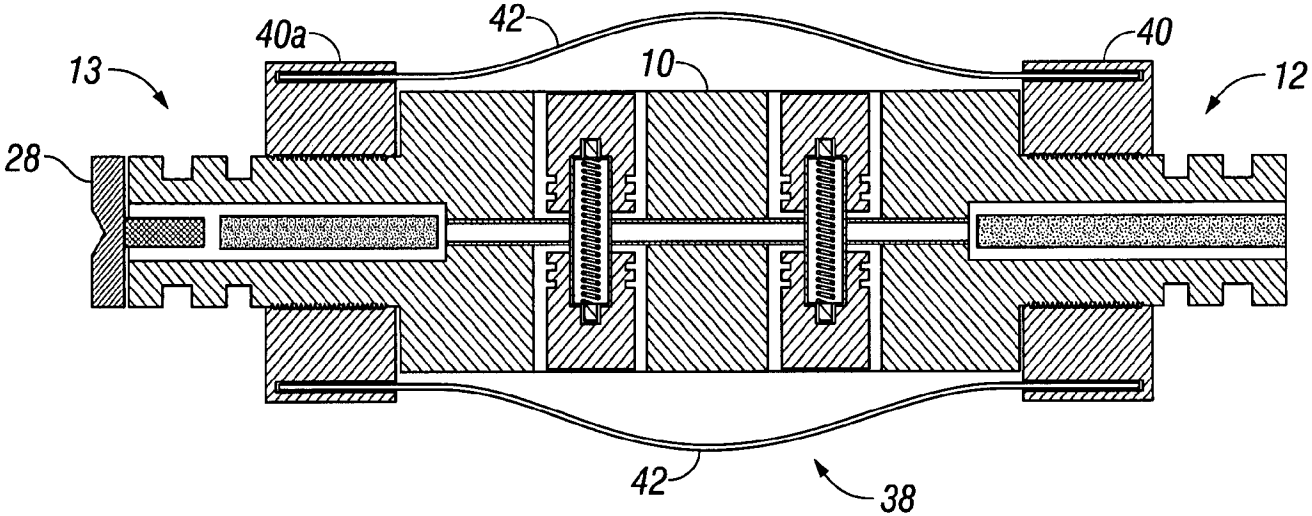
FIG. 4 illustrates an elevated side view partially in cross-section of an embodiment of a centralizing spring for the anchor according to the present invention.

FIG. 4 illustrates another embodiment of the anchor sub 10. This embodiment further illustrates the use of a bow spring collar 38 which is used to centralize the anchor sub 10 within the tubular into which it is lowered. Preferably, the bow spring collar 38 comprises a collar 40 which is slidably inserted over lower end 12, and a second collar 40*a* which is slidably insertable over upper end 13. It should be appreciated that collars 40, 40*a* can be inserted in a variety of ways including threaded connections, welded connections, pin connections, screwed or bolted connections, and the like. Preferably, at least two springs 42 extend between collars 40, 40*a*. The springs 42 are preferably sized such that when the anchor sub-body 10 is inserted in a tubular, the springs 42 will contact the inner diameter of the tubular, and maintain the anchor sub 10 in a position substantially central to the inside diameter of the tubular into which the anchor sub 10 is being lowered. It should be understood that as a minimum, at least two springs 42 are utilized. However, it is envisioned that more than two springs can also be utilized to maintain a more exact centralization of the anchor body 10. Preferably, each end, of the bow springs 42, is attached to collars 40, 40*a* respectively by screws. However, it should be understood that the method of attachment of bow springs 42 to collars 40, 40*a* can comprise a variety of attachment means, including welding, screws, bolts, pins, rivets, and the like. It should be further understood, particularly by referring to the illustration in FIG. 4, that the collars 40, 40*a* will be further retained in place when the anchor tool 10 has been attached to the chemical cutter on lower end 12 and other lowering means on upper end 13.

Figure 1A:
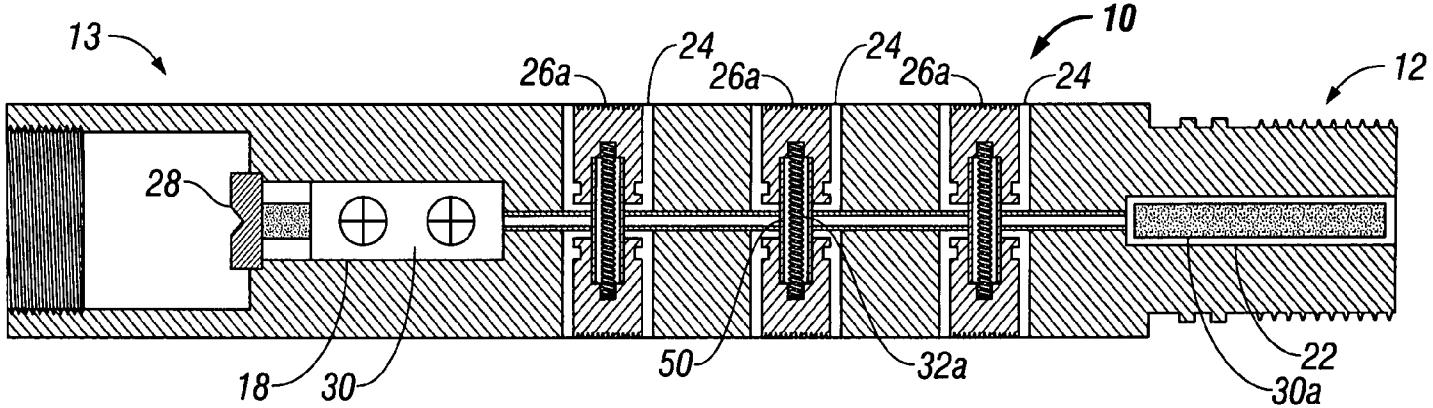
FIG. 1A illustrates an elevated side view partially in cross-section of an alternative embodiment of the anchor according to the present invention.
Figure 5:
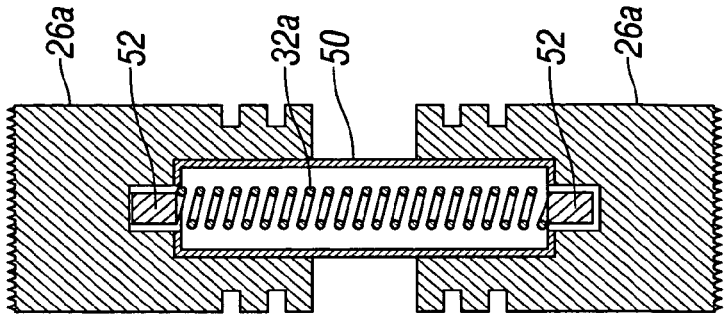
FIG. 5 illustrates an elevated side view partially in cross-section of an alternative embodiment of a housing for protecting the retaining springs for the anchor according to the present invention.

Referring now to FIGS. 1A and 5, yet another alternative embodiment is illustrated for an internal spring retention system for the anchor slips 26*a*. In this embodiment, the slips 26*a* are retained in the anchor sub 10 by internally mounted springs 32*a*. It should be understood that the function of the springs 32*a* is similar to the function of the springs 32, described herein above, in that the springs 32*a* are preferably designed so as to retain the slips 26*a* inside the anchor sub 10 body, while at ambient wellbore pressure. However, after the ignition of the gas generating propellant 30, 30*a*, the springs extend as the pressure pushes the slips 26*a* through the apertures 24 and in contact with the tubular to be cut. In this embodiment, the springs are protected, from bending stresses otherwise exerted by the generated pressure, by a housing 50. The housing 50 preferably extends between two slips 26*a* which are substantially diametrically opposed to one another. The housing 50 extends into an internal bore of the slips 26 and may be attached to the slips (illustrated by elements 52) in a conventional manner. The springs 32*a* are inserted into the housing 50 and extend between the two slips 26*a* in the housing 50. It should be understood that the springs are preferably attached to the slips 26*a* by set screws, welds, other threaded fasteners, pins, or like methods. It should be further understood that the attachment of the spring 32*a* ends may also attach the housing 50 ends to the respective slip 26*a*.

Figure 6:
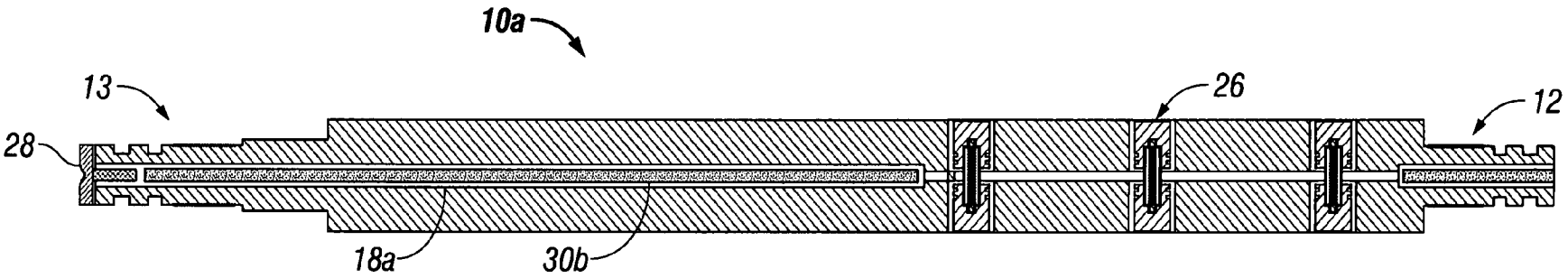
FIG. 6 illustrates an elevated side view partially in cross-section of an alternative embodiment of the anchor according to the present invention.

Referring now to FIG. 6, yet another alternative embodiment is illustrated for the anchor. In this embodiment, the anchor, designated for clarity as 10*a*, preferably only chamber 18*a* will contain the gas generator propellant 30*b*. It should be appreciated that the gas generator propellant 30*a* can be a single charge (or charge container) or may be more than a single charge. However, even the multiple charges will only be placed within the chamber 18*a*. It should be further appreciated that this embodiment will still require an ignitor 28 which will preferably be activated in a conventional manner. The end configurations of the anchor 10, as well as the anchor blocks 26 and retainer springs 32, may be as described hereinabove for other embodiments. It should be appreciated that the various embodiments, of the anchor 10, 10*a* may vary dimensionally depending on the exact application and other factors including, but not limited to, casing/tubular diameters, amount of required gas generator propellant 30, 30*a*, 30*b*, the number and placement of the anchor blocks 26, and other tools or equipment that may be attached uphole or downhole of the anchor 10, 10*a*.

OPERATION

In an operation, wherein for example a tubular is to be cut, typically, a position where the tubular is desired to be cut is predetermined. The chemical cutter assembly, which includes anchor sub-body 10, is then lowered into the wellbore, and into the tubing to the position to be cut. Preferably, when the tool, including anchor sub-body 10 is lowered, it is attached to a wire line (not shown). The wire line is typically capable of carrying electronic signals and/or current. Preferably, the wire line will be connected to the ignitor 28 and after the tool assembly has reached the desired position, an electrical current is sent through the wire line to the ignitor 28. The ignitor 28 which is typically a black powder ignitor, in turn, initiates the ignition of the pressure propellant 30 located in upper end 13. It should be understood, as described herein above, that the type, position, and number of ignitors 28 could vary as well as a variety of methods to actuate the ignitor(s) 28. The ignition of the pressure propellant 30 will cause the ignited material to flow through medial chamber 20, and will also cause pressure to begin building in medial chamber 20. At substantially the same time, the ignition of pressure propellant 30 will cause the ignition of pressure propellant 30*a*, due to the high heat generated therein. As pressure propellant 30*a* ignites, it also begins instantaneously creating a high pressure. Typically, a rupture disc will be located in the chemical cutter directly below the lower end 12. It should be understood that the rupture disc is not a part of this invention, and is located in the chemical cutter, and is therefore not described in detail herein. The rupture disc, when anchor sub body 10 is attached to the chemical cutter, will prevent the flow of pressure out of the anchor sub 10. It should be understood, that the flow of pressure, in an uphole direction is also prevented by the use of conventional seal means (not illustrated). Such sealing means being in contact with or near upper end 13 and/or ignitor 28. As pressure continues to build within medial chamber 20, anchor slips or blocks 26, are forced in an outwardly direction out of apertures 24. Preferably, the pressure will reach a level to overcome springs 32 and allow the extension of anchor slips or blocks 26. As the anchor slips or blocks 26, are forced out of the anchor sub-body 10, they will preferably contact the internal surface of the tubing to be cut, and will substantially positively anchor the anchor sub 10, and consequently, any tools attached above and below anchor sub 10, including the chemical cutter.

As is well known in the art, after the pressure sufficiently builds in the anchor sub 10 the pressure will eventually overcome the rupture disc located below anchor sub 10, and the pressure will dissipate through the rupture disc, after it is broken, and will further rupture another disc and release the chemical cutting agent. After the chemical cutting agent has been released and has severed the pipe, the pressure will dissipate in medial chamber 20, as well as chambers 18 and 22. After the pressure has dissipated, the springs 32 will contract, and will bring anchor slips or blocks 26 back into the retracted position. At this point, the tool can be removed from the tubular. It should be appreciated that the pressure producing propellant 30 and 30*a* is a compound well known in the art, and is typically an ammonium nitrate base with a hydrocarbon binder. However, it should be appreciated that other types of pressure producing propellants can be utilized, and should not be viewed as a limitation herein. It should be appreciated that the above described operation can be similarly carried out regardless of the type of tool attached to and utilizing the anchor.

It will be understood that certain features and sub-combinations are of utility and may be employed without reference to other features and sub-combinations. This is contemplated by and is within the scope of the claims. It may be seen from the preceding description that a novel anchor and anchoring system has been provided. Although specific examples may have been described and disclosed, the invention of the instant application is considered to comprise and is intended to comprise any equivalent structure and may be constructed in many different ways to function and operate in the general manner as explained hereinbefore. Accordingly, it is noted that the embodiments described herein in detail for exemplary purposes are of course subject to many different variations in structure, design, application and methodology and any such variations may be made without departing from the spirit of the invention. Moreover, it will be understood that various directions such as "top," "bottom," "left," "right," "inwardly," "outwardly," and so forth are made only with respect to easier explanation in conjunction with the drawings and that the elements may be oriented differently, for instance, during transportation and manufacturing as well as operation. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the elements of the invention may be greatly different from that shown and still operate well within the spirit of the invention as described hereinbefore and in the appended claims. It will be seen that various changes and alternatives may be used that are contained within the spirit of the invention. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An anchor for detachably anchoring a tool in a predetermined position inside a tubular member for work to be done comprising:

a single sub anchor body having a first end, a second end, an exterior surface, and an interior surface;

said single sub anchor body comprising at least one longitudinal chamber;

said at least one longitudinal chamber further comprising a first chamber a second chamber and a third chamber, wherein said first chamber has an internal diameter which is smaller than an internal diameter of the second chamber and/or the third chamber;

said single sub anchor body comprising at least one transverse chamber, wherein the first chamber and the transverse chamber intersect with one another;

at least one pressure producing propellant, said pressure producing propellant being positioned in said longitudinal chamber for activation; and at least one anchor block being slidably retained in the transverse chamber, said anchor block being driven from the transverse chamber to grippingly contact an inner surface of the tubular after activation of the pressure producing propellant, wherein the gripping contact anchors said anchor body.

2. The anchor of claim 1, further comprising an urging device to retain said anchor block in said transverse chamber, wherein said urging device is overcome by a pressure produced by a pressure producing propellant, and wherein said anchor block is driven from the transverse chamber as the urging device is overcome.

3. The anchor of claim 2, wherein said urging device urges said anchor block to retract into said transverse chamber after said pressure, produced by said pressure producing propellant, exhausts through said anchor.

4. The anchor of claim 2, wherein said urging devise is a plurality of springs being configured to be slidably inserted in said transverse chamber medial to the transverse chamber and said anchor block.

5. The anchor of claim 4, further comprising a plurality of housings, said housings positioned so as to protect said plurality of springs from fluids and/or pressure contained in or moving through said longitudinal chamber and/or said transverse chamber.

6. The anchor of claim 4, wherein said plurality of springs expand to allow movement of said anchor block out of said transverse chamber, and wherein said springs contract to bring said anchor block to a retracted position, said anchor block being in gripping contact with said inner surface of the tubular when said springs are extended and said anchor block releasing said gripping contact when said springs are contracting.

7. The anchor of claim 1, said first end and said second end each having external threads for connecting said anchor to a tubular string and/or another tool.

8. The anchor of claim 7, wherein said ignitor is remotely energized, from outside said tubular, and wherein said energized ignitor ignites said at least one pressure producing propellant, said ignition further causing the production of pressure as the propellant combusts, and further wherein said pressure producing propellant is in communication with the longitudinal and/or transverse chambers.

9. The anchor of claim 1, wherein said pressure producing propellant creates pressure when ignited.

10. The anchor of claim 1, further comprising a bow spring collar disposed about said exterior surface, wherein said bow spring collar substantially centers said anchor in the tubular into which it is lowered.

11. The anchor of claim 1, further comprising at least one ignitor, said ignitor being positioned proximate to the longitudinal chamber.

12. The anchor of claim 1, wherein said longitudinal chamber further comprises at least two different inside diameters.

13. The anchor of claim 1, wherein the tool to be anchored is a chemical cutting apparatus.

14. The anchor of claim 1, wherein the tool to be anchored is capable of cutting and/or piercing a wall of a tubular.

15. A method for using an anchor capable of being positioned inside a throughbore of a tubular comprising the steps of:

assembling a single sub anchor having a longitudinal chamber comprising three subchambers, wherein said assembly comprises loading more than one pressure producing propellent into each of a second subchamber and a third subchamber located at each end of said anchor and mounting an ignitor to said anchor, said ignitor being in communication with said pressure producing propellants;

enabling communication between said ignitor and an ignition source, said ignition source capable of actuating said ignitor;

mounting said single sub anchor to a tool, wherein the tool is to be substantially anchored in a predetermined position within a tubular;

lowering said single sub anchor and tool into a tubular, said anchor being mounted near a lower end of a lowering apparatus;

continue lowering said single sub anchor until reaching a predetermined position within the tubular;

actuating said ignitor, wherein said ignitor ignites the pressure producing propellants upon being actuated;

propelling the pressure into a first subchamber, wherein said first subchamber is medial to said pressure producing propellants and is in direct contact with anchor blocks, and wherein said first chamber has a smaller internal diameter than the second and/or the third chambers containing the pressure producing propellant; and extending anchor blocks to grip an interior surface of the tubular, wherein said anchor blocks is housed in said single sub anchor medial to said more than one pressure producing propellants, and wherein said extending of the anchor blocks being caused by pressure generated by the ignition of the pressure producing propellants, and further wherein the anchor blocks position said single sub anchor so as to substantially prevent movement along a longitudinal axis defined by the single sub anchor.

16. The method of claim 15, wherein the tool to be anchored is a chemical cutting apparatus.

17. The method of claim 15, wherein the tool to be anchored is capable of cutting and/or piercing a wall of a tubular.

18. An anchor for detachably anchoring a tool in a predetermined position inside a tubular member for work to be done comprising:

a single sub anchor body comprising a first body, a second body, and a third body;

the first body comprising two ends, said first body having an exterior surface and an interior surface, said first body defining a first chamber therein and forming a plurality of apertures in an exterior surface of said first body;

the second body comprising two ends, said second body having an exterior surface and an interior surface, said second body defining a second chamber therein said second chamber receiving a pressure producing propellant, said second body being fixedly attached at one end to said first body, said second body being capable of connecting to an apparatus for lowering said anchor into a tubular member, wherein the connection is at the end distal from the attachment to said first body;

the third body comprising two ends, said third body having an exterior surface and an interior surface, said third body defining a third chamber therein said third chamber receiving a pressure producing propellant, said third body being fixedly attached, at one end to said first body, wherein such attachment is at an opposite end, of said first body, from said second body, and the third body end distal from said first body being capable of connecting to another tool, wherein said first, second, and third chambers are in communication with one another;

a plurality of slips slidably retained in said plurality of apertures formed by at least one said exterior surface, said apertures being in fluid communication with said first chamber, said plurality of slips capable of extending from said apertures to grippingly contact an inner surface of a tubular, into which the anchor is installed, said extended plurality of slips substantially prevent movement of said anchor in a direction along the longitudinal axis of said anchor; and a plurality of springs configured to retain said plurality of slips in said apertures at ambient wellbore pressure, wherein said retention of slips allows said anchor to move in a direction substantially parallel to its longitudinal axis, and wherein said plurality of springs extend when a pressure, produced by a pressure producing propellant, is exerted upon said plurality of slips causing said plurality of slips to extend outwardly into gripping contact with said inner surface of said tubular, and wherein said spring extension allows said plurality of slips to extend and grippingly contact said inner surface of said tubular.

19. The anchor of claim 18, wherein said plurality of springs contract after said pressure, produced by said pressure producing propellant, exhausts through said anchor, said contraction of said springs causing said plurality of slips to retract allowing said anchor to move in a direction substantially parallel to its longitudinal axis.

20. The anchor of claim 18, wherein said second and said third chambers are configured to accept a pressure producing propellant, wherein the propellant creates pressure when ignited.

21. The anchor of claim 18, wherein said second body and said third body are integral with said first body.

22. The anchor of claim 18, wherein said second body and said third body are threadedly attached to said first body integral with said first body.

23. The anchor of claim 18, wherein said second body and said third body are weldably attached to said first body integral with said first body.

24. The anchor of claim 18, further comprising a bow spring collar disposed about at least one said exterior surface, wherein said bow spring collar substantially centers said anchor in the tubular into which it is lowered.

25. The anchor of claim 18, further comprising at least one ignitor, said ignitor being positioned proximate to said second chamber and/or third chamber.

26. The anchor of claim 25, wherein said ignitor is remotely energized, from outside said tubular into which it is lowered, and wherein said energized ignitor ignites at least one pressure producing propellant, said ignition further causing the production of pressure as the propellant burns, and further wherein said pressure producing propellant is in communication with the first chamber.

27. The anchor of claim 18, wherein said plurality of springs being configured to be slidably inserted in said apertures medial to at least one said chamber and said slips.

28. The anchor of claim 27, further comprising a plurality of housings, said housings positioned so as to protect said plurality of springs from fluids and/or pressure contained in or moving through at least one said chamber.

29. The anchor of claim 27, wherein said plurality of springs expand to allow movement of said slips out of said apertures, and wherein said springs contract to bring said slips to a retracted position, said slips being in gripping contact with said inner surface of the tubular when said springs are extended and said slips releasing said gripping contact when said springs are contracting.

30. The anchor of claim 18, wherein said first chamber has an internal diameter which is smaller than an internal diameter of the second chamber and/or the third chamber.

31. The anchor of claim 18, wherein the tool to be anchored is a chemical cutting apparatus.

32. The anchor of claim 18, wherein the tool to be anchored is capable of cutting and/or piercing a wall of a tubular.

* * * * *